US007101157B2

(12) United States Patent
Bamberger et al.

(10) Patent No.: US 7,101,157 B2
(45) Date of Patent: Sep. 5, 2006

(54) COOLING ARRANGEMENT FOR AN ELECTROMOTOR

(75) Inventors: Bernhard Bamberger, Lauda (DE); Dieter Best, Ingelfingen (DE); Birgit Brausch, Mulfingen (DE); Martin Buerkert, Doerzbach (DE); Erich Fiedler, Neusitz (DE); Helmut Lipp, Doerzbach (DE); Friedrich Schaffert, Schrozberg (DE); Reinhard Stillger, Oehringen (DE)

(73) Assignee: EBM-PAPST Mulfingen GmbH & Co. KG, Mulfingen (DE)

( * ) Notice: Subject to any disclaimer, the term of this patent is extended or adjusted under 35 U.S.C. 154(b) by 293 days.

(21) Appl. No.: 10/299,629

(22) Filed: Nov. 19, 2002

(65) Prior Publication Data

US 2004/0096339 A1 May 20, 2004

(51) Int. Cl.
*F04B 17/03* (2006.01)
*H02K 9/06* (2006.01)

(52) U.S. Cl. ..... 417/368; 417/423.8; 310/62

(58) Field of Classification Search ..... 417/423.8, 417/423.14, 350, 365, 368; 310/59, 67 V, 310/89, 71, 62

See application file for complete search history.

(56) References Cited

U.S. PATENT DOCUMENTS 4,963,778 A * 10/1990 Jensen et al. ..... 310/68 D
5,156,535 A * 10/1992 Budris et al. ..... 417/423.7
6,011,331 A * 1/2000 Gierer et al. ..... 310/58
6,082,974 A * 7/2000 Takemoto et al. ..... 417/366
6,561,772 B1 * 5/2003 Volkert et al. ..... 417/312

FOREIGN PATENT DOCUMENTS

DE 3842588 A1 6/1990
DE 4122529 A1 1/1993
DE 10160820 A1 8/2002

* cited by examiner

*Primary Examiner*—Charles G. Freay
(74) *Attorney, Agent, or Firm*—Brinks Hofer Gilson & Lione

(57) ABSTRACT

The present invention provides a high-pressure blower comprising a fan arrangement which includes a fan, and a fan housing for conveying working air. An electromotor drives the fan via a motor shaft to provide motor self-ventilation by generating a cooling air stream flowing through the motor due to a cooling wheel driven by the rotor. A wall section separates the interior space of the fan housing accommodating the fan airtight from the interior space of the blower accommodating the electromotor so that the cooling air stream flowing through the electromotor is separated and independent of the air flow of the working air conveyed to the fan.

14 Claims, 8 Drawing Sheets

COOLING ARRANGEMENT FOR AN ELECTROMOTOR

BACKGROUND OF THE INVENTION

The present invention relates to a blower, especially high-pressure blowers, comprising of a fan arrangement consisting of a fan and a fan housing for conveying working air. The invention moreover relates to a cooling arrangement for an electromotor with means for motor self-ventilation accomplished by generating a cooling air stream flowing through the motor, especially by means of a cooling wheel provided on the rotor.

BRIEF SUMMARY OF THE INVENTION

For self-ventilating an electromotor, it is well known to attach a small cooling wheel, in the manner of an axial fan, on the rotor of the electromotor so that the cooling wheel, which rotates with the rotor, will generate a cooling air stream flowing through the motor while the rotor rotates.

Electronically commutated DC motors, in which motor electronics control the commutation of the winding currents collectorless, are often used today. Some of the electronic components of the motor electronics, especially power semiconductors, generate heat through dissipation power, so that cooling measures are indicated in this area.

Thus DE3842588A1 describes an example of such a collectorless external rotor motor with a semiconductor cooling arrangement, the power semiconductors being electrically connected to a printed circuit board but themselves being arranged on a cooling attachment shaped like a flat ring. The cooling attachment thereby indirectly connects the power semiconductors heat-conducting with a motor flange so that the heat from the motor flange is lost to the surroundings. Together with the circuit board and a supporting element fastening the circuit board, the cooling attachment forms a pre-assembled subassembly, which is attached in the vicinity between the motor flange and the open side of the external rotor bell. However, a special cooling air stream is not described.

DE4122529A1 likewise describes an electronically commutated driving motor. A printed circuit board containing components of the motor electronics is accommodated in a space between a disk-shaped carrier (motor flange) and an external lid mounted on the side opposite the motor. To eliminate the heat arising from the commutation, the carrier is supposed to demonstrate a ring wall enclosing the rotor externally. This ring wall consequently functions as a cooling attachment by enlarging the surface of the carrier. However, a special cooling air stream is not described here either.

One problem that the present invention is intended to solve consists of creating a cooling arrangement as described in the introduction that generates a cooling air stream and also ensures effective cooling of heat-generating components of the motor electronics.

The invention furthermore solves the problem that for known fans, such as described in DE10160820A1, there occurs a mixture of the cooling air stream with the blown-off current of working air, because a portion of the air that cools the motor and the electronics is taken from the air current of the fan. This results in dirty air being conveyed over the electronics and through the motor.

The present problem is solved according to invention, in that a housing accommodating the electromotor is connected with the blow-off housing in such a manner that the working air stream is separated from the cooling air stream flowing in the electromotor housing, and the cooling air stream escapes through holes in the peripheral wall of the electromotor housing. In accordance with the present invention, the working air stream of the fan and the cooling air stream are thus separated and independent from each other. The cooling air can be drawn from outside according to invention, spread along the outside of the encapsulated electronics, and nevertheless also flow through the air gap of the motor between rotor and stator.

It is moreover provided according to invention, that motor electronics are arranged against direct contact with the cooling air stream, the motor electronics being chambered within a housing compartment bordered by a cooling attachment and the cooling air stream being conveyed past the housing compartment in such a manner that it flows over the outside surface of the cooling attachment, which outside surface is turned away from the motor electronics, whereas the inside surface of the cooling attachment is turned toward the motor electronics and demonstrates cooling surfaces standing in heat-conducting bearing contact with components of the motor electronics to be cooled.

According to invention the cooling air stream, which is initially generated for motor self-ventilation, is thus also used to cool the motor electronics. But here it is advantageous for the motor electronics to be accommodated chambered in such a manner, that direct contact with the cooling air stream is impossible. Rather, indirect cooling occurs according to invention, the flow occurring over the opposite side of the cooling attachment. The components dissipate the heat through the adjacent cooling surfaces of the cooling attachment. This arrangement according to invention prevents any pollutants and/or moisture, which could cause electrical problems, from reaching the vicinity of the motor electronics with the cooling air. Preferably the chambering of the motor electronics according to invention can even make it possible to dispense with encapsulating the electronics as a whole with an insulating potting compound. This will contribute to simple and economical manufacturability.

Other advantageous development characteristics and advantages of the invention are contained in the dependent claims and the following description.

The invention will be explained in more detail based on a preferred exemplary embodiment illustrated in the drawing. The drawing shows:

BRIEF DESCRIPTION OF THE DRAWINGS

The same parts are always labeled with the same reference characters in the various figures of the drawing and each will therefore only be described once.

DETAILED DESCRIPTION OF THE PREFERRED EMBODIMENT

Figure 2:
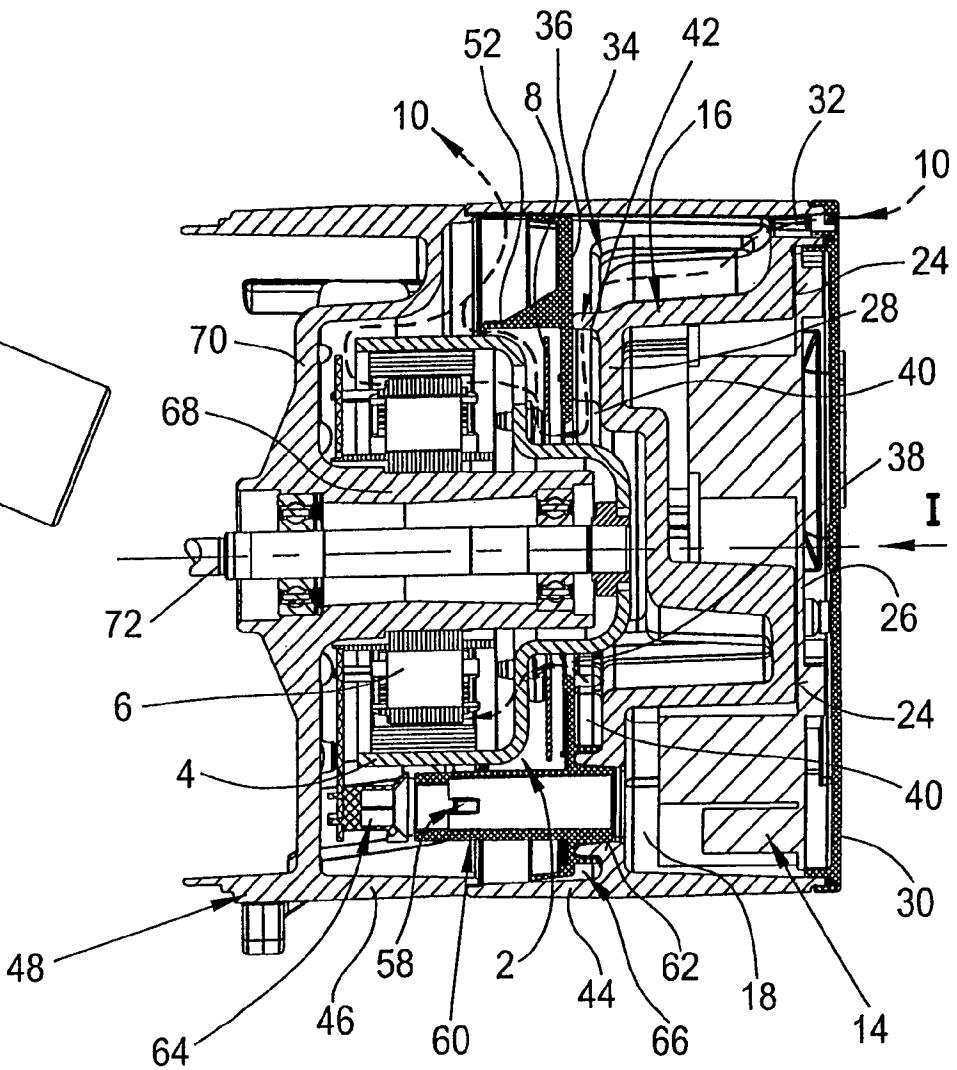
Figure 9:
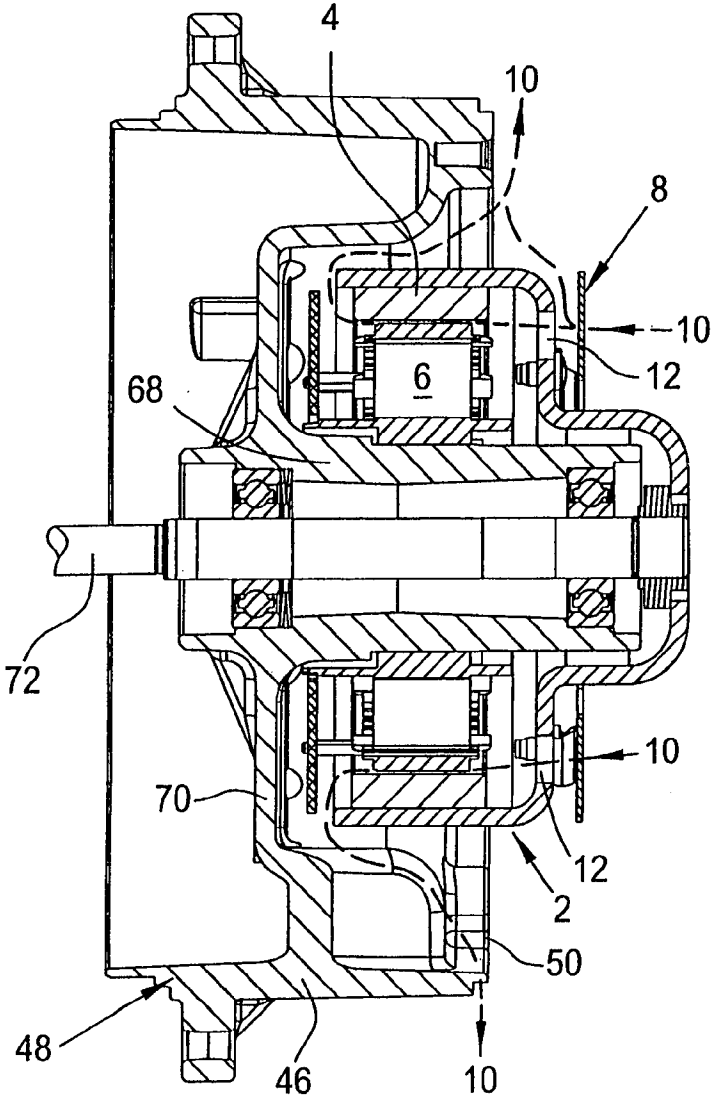

As is first seen from FIGS. 2, 3, 8, and 9, an electromotor 2 is preferably designed as an external rotor motor, a rotor 4 in the form of a bell-shaped or pot-shaped external rotor enclosing an interior stator 6. On its closed side, the rotor 4 carries a cooling wheel 8 in the manner of a small radial or axial fan in order to generate a cooling air stream 10 streaming through or around a motor 2 for motor self-ventilation. FIGS. 2 and 9 each indicate this cooling air stream 10 by dashed lines. For this, the front side of rotor 4, which side supports the cooling wheel 8, demonstrates axial flow holes 12 for the cooling air stream 10. The cooling wheel 8 can advantageously be made from a disk, especially a disk made of a sheet material, wherein this disk may demonstrate free-punched and bent elements operating as blades. For this, see FIG. 8 in particular. In a preferred embodiment, the rotor 4 is designed stepwise. Here a region of the rotor with a reduced diameter, the region that is assigned to the closed pot side and elongated over the rotor sheet stack, is offset radially inwards. This has the advantage on the one hand that the bearing span of the motor can be increased, which contributes to a substantial improvement in the durability of the motor's mounting, and on the other hand that the compact structural shape of the motor can be preserved.

As evident from FIGS. 2 through 5, motor electronics 14, which are provided especially for electronic commutation control, are arranged chambered within a housing compartment 18 bordered by a cooling attachment 16 in such a manner that they (the motor electronics 14) are protected from direct contact with the cooling air stream 10. The cooling air stream 10 nevertheless also cools the motor electronics 14 by being conveyed past the housing compartment 18 in such a manner that it flows over the outside surface 20 of the cooling attachment 16, the outside surface being turned away from the motor electronics 14. The opposite inside surface 22 of cooling attachment 16, which inside surface is turned toward the motor electronics 14, demonstrates cooling surfaces 24 by means of which the cooling attachment 16 stands in heat conducting bearing contact with components or regions of the motor electronics 14 that must be cooled.

Figure 4:
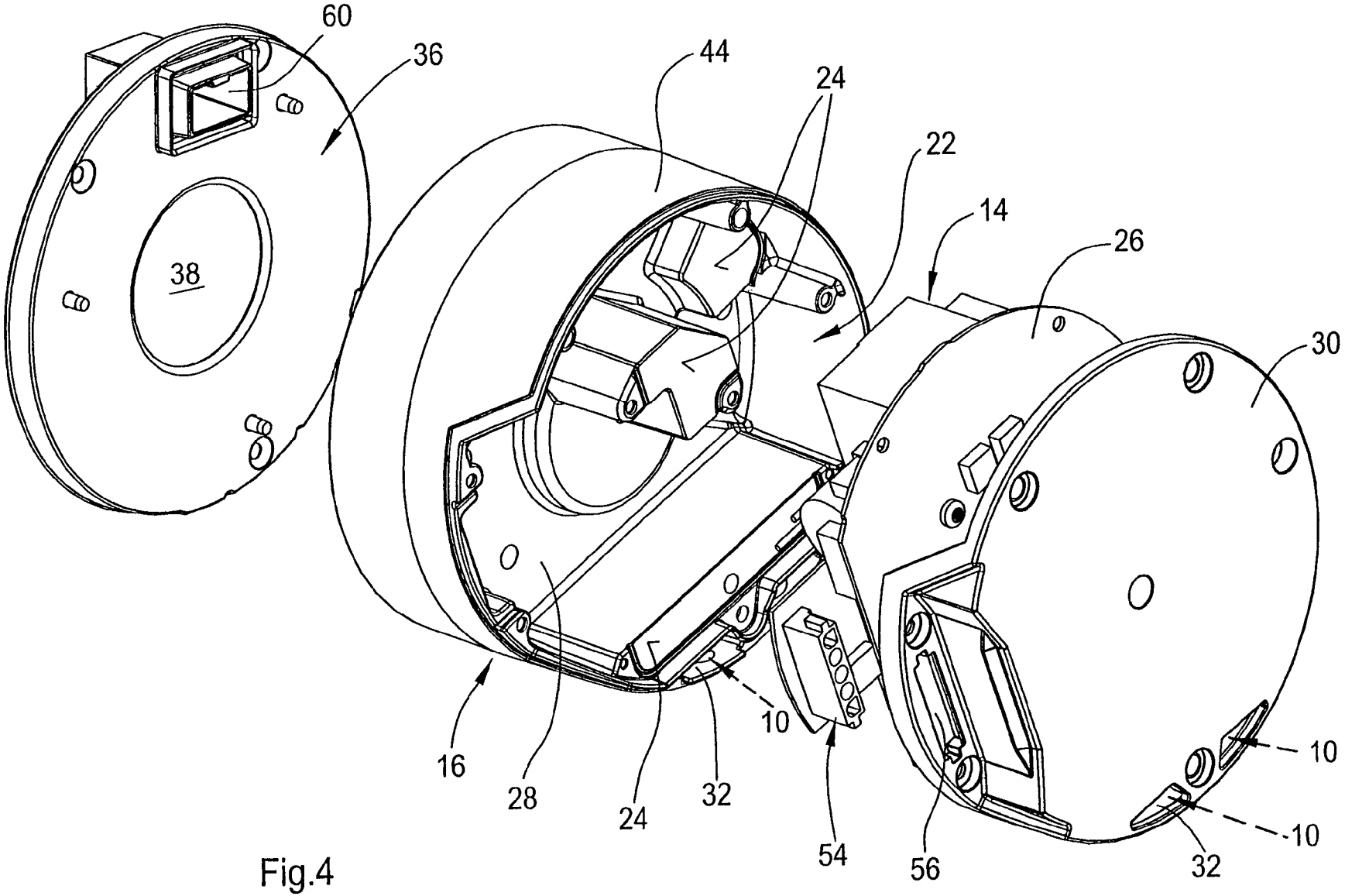
Figure 5:
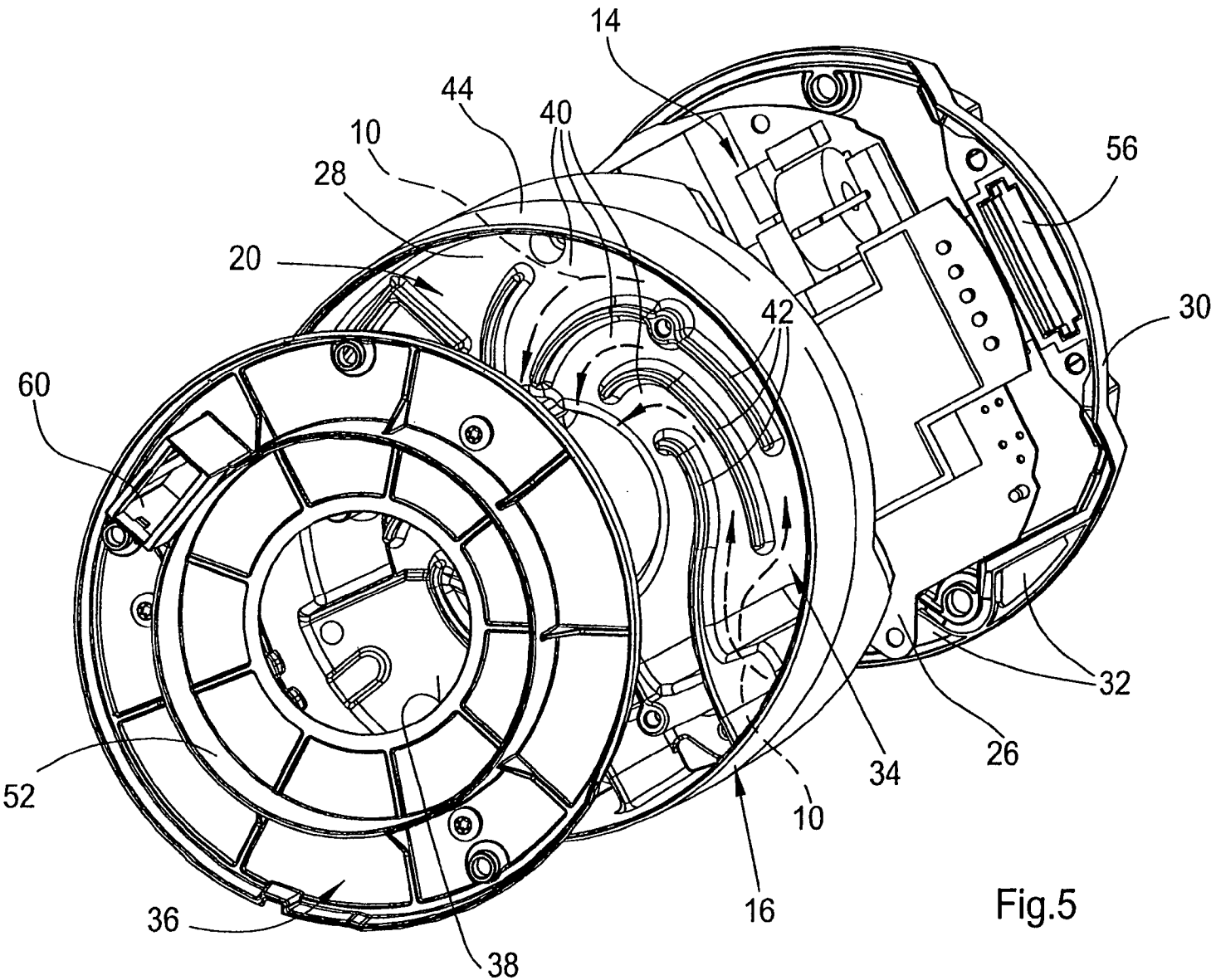

As seen in FIGS. 4 and 5, the motor electronics 14 demonstrate a supporting plate 26, which bears the components and extends perpendicular to the motor axis, and which can be made of a printed circuit board. The cooling attachment 16 demonstrates a bottom wall 28, which is basically parallel to the supporting plate 26. The arrangement is preferably in such a manner that the bottom wall 28 of cooling attachment 16 borders the housing compartment 18 on the side that is axially turned toward the electromotor 2, and a separate lid component 30, which is connected to the cooling attachment 16, borders the other axial side of the housing compartment 18, the side that faces way from the motor 2, the housing compartment 18 accommodating the supporting plate 26. This means that the outside surface 20 of cooling attachment 16 is turned toward the motor 2, whereas the inside surface 22 faces away from motor 2. On its inside surface 22, which is turned away from the motor electronics 14, the bottom wall 28 demonstrates a relief-like face structure, which is matched to the particular arrangement of components on supporting plate 26 to form the cooling surfaces 24; see FIGS. 4 and 6 in particular.

In particular, the cooling attachment 16 together with the lid component 30 forms at least one preferred axial admission channel 32 leading past the housing compartment 18, two admission channels 32 being located next to each other in the external peripheral region in the illustrated example. On the outside surface 20 of the cooling attachment 16, which surface is turned toward the motor 2, the or each admission channel 32 merges into a rear-flow chamber 34. The bottom wall 28 of the cooling attachment 16 borders this rear-flow chamber 34 in the axial direction toward the housing compartment 18 and motor electronics 14 on one side, and an extra partitioning wall 36 borders this rear-flow chamber 34 in the axial direction toward the motor 2 on the other side (cf. the perspective drawings in FIGS. 4 and 5). Here the centric vicinity of partitioning wall 36 demonstrates a transition hole 38 for the cooling air stream 10 flowing toward the motor 2. In the preferred embodiment, the end of the rotor 4, which is offset radially inwards, reaches through the transition hole 38, an adequately wide annular gap serving the cooling air stream 10 being formed between the rotor 4 and transition hole 38.

In this manner, the air drawn by the cooling wheel 8 first flows axially through the admission channels 32, then flows along the outside surface 20 of cooling attachment 16 through the rear-flow chamber 34, and then flows further through the transition hole 38 of the partitioning wall 36 over the cooling wheel 8 to the motor 2. The air then flows axially through the air gap between stator 6 and rotor 4 and within a bypass to a first vicinity of the rotor, then flows around axially back to the rotor 4, and is then radially carried off to the outside. The reader is referred to FIG. 2 in particular.

Figure 7:
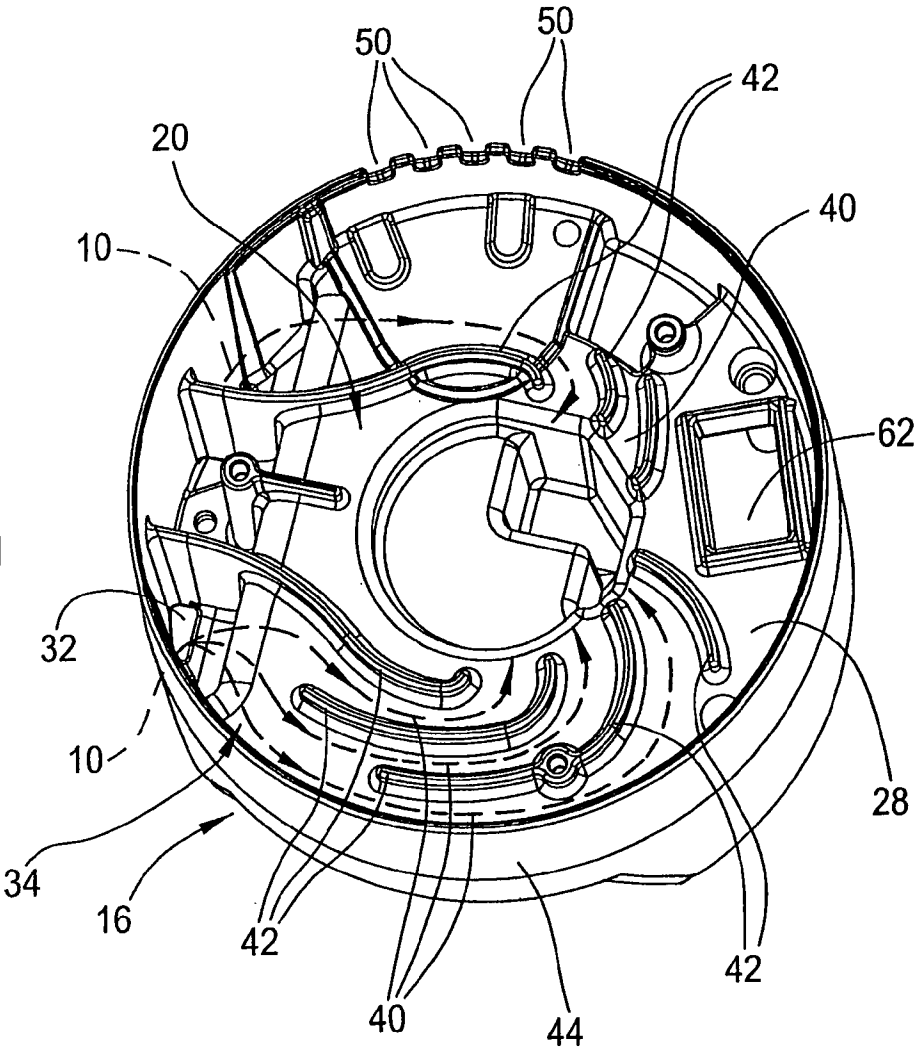

As is furthermore evident from FIGS. 5 and 7, flow channels 40 are formed within the rear-flow chamber 34 in such a way that the cooling air stream 10 flows over the bottom wall 28 on the outside surface 20 of the cooling attachment 16 in a suitable manner. A largely uniform flow over the surface can thus be achieved. But it can be advantageous to provide for a locally reinforced flow over the surface of the cooling attachment to match the arrangement of the components and cooling surfaces 24. In the illustrated, preferred embodiment, air guide ribs 42 on the outside surface 20 of the bottom wall 28 of the cooling attachment 16 form the flow channels 40. But it is alternatively possible to also provide ribs on the partitioning wall 36. In an advantageous embodiment of the invention, the flow channels 40 can be designed with a cross section that matches the volume flow of the cooling air stream 10 drawn by the cooling wheel 8 in such a manner that the flow in the vicinity of the flow channels 40 attains such a relatively high flow velocity that it prevents the deposit of air constituents, such as dirt particles and/or moisture.

Figure 3:
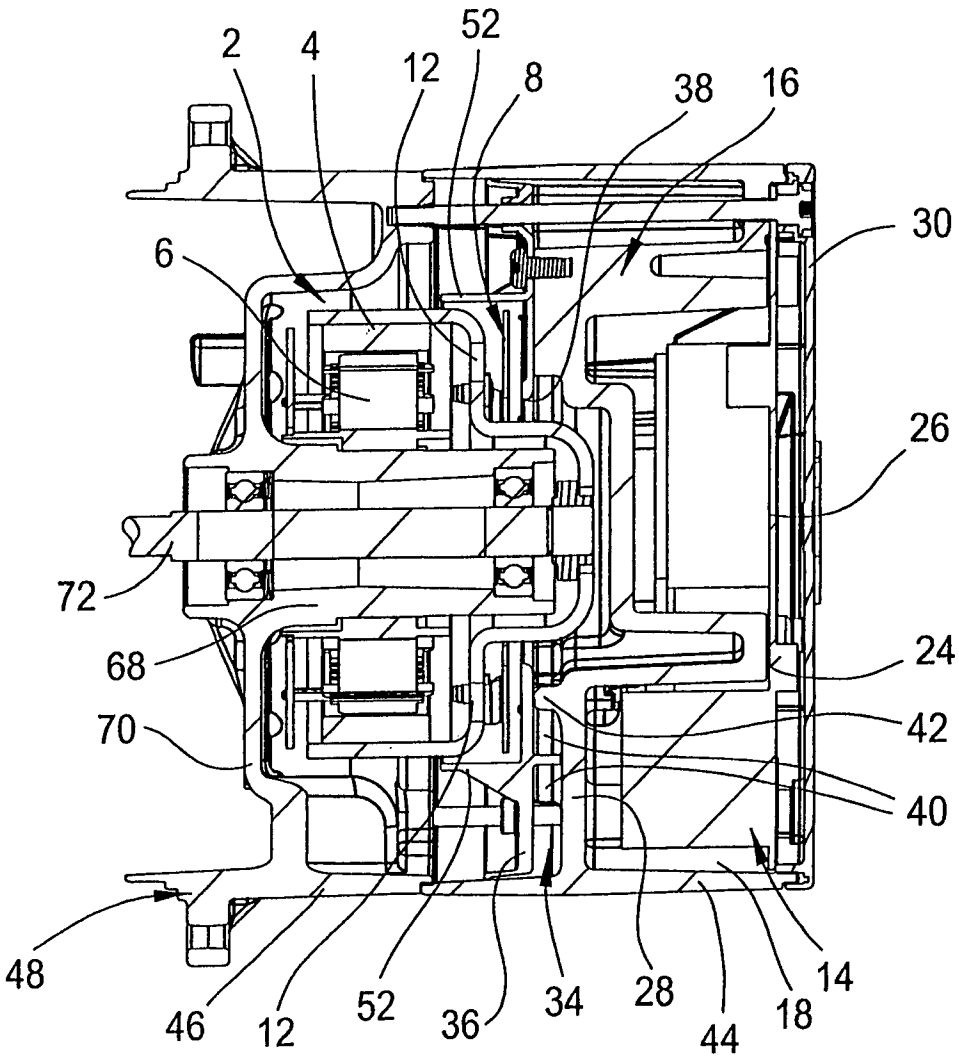
Figure 6:
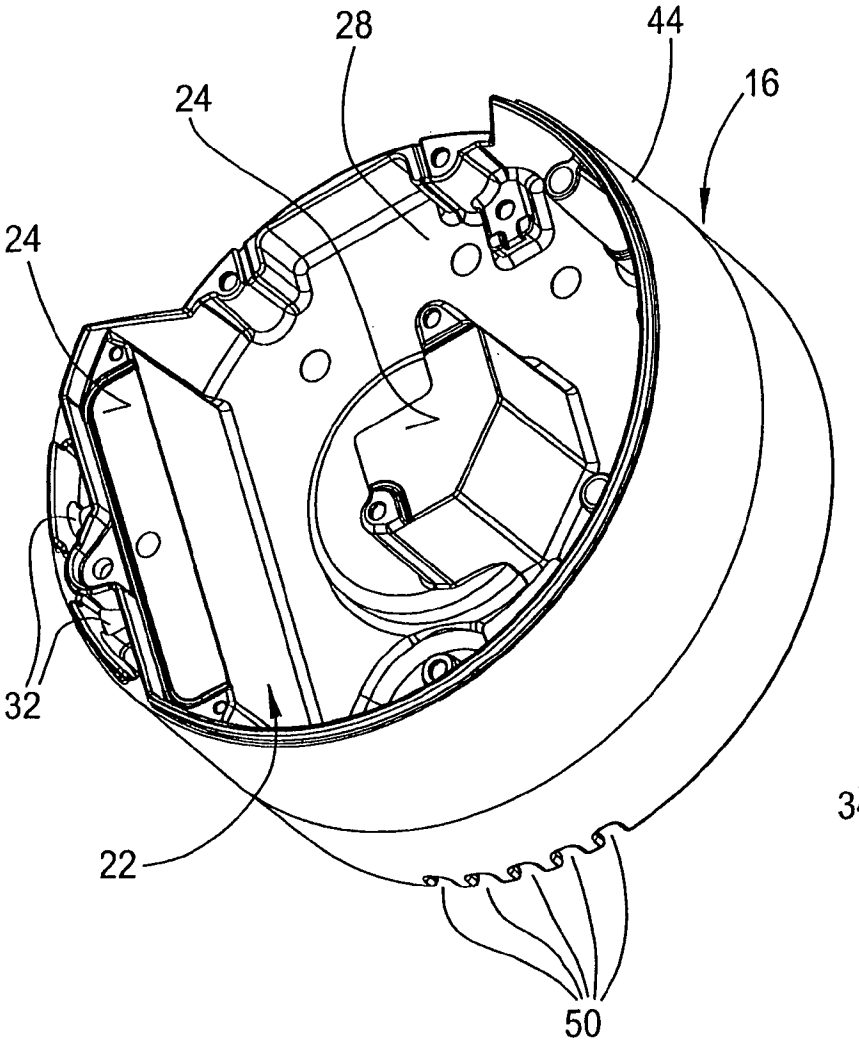
Figure 8:
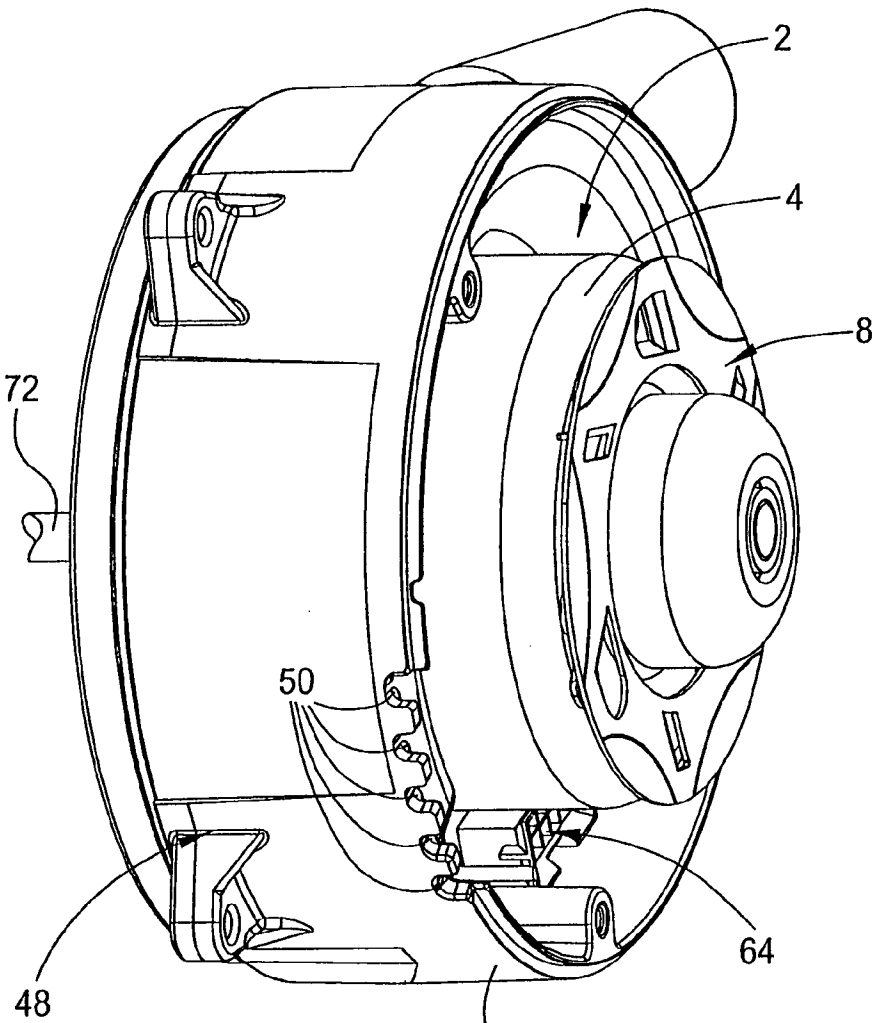

In the preferred embodiment, the cooling attachment 16 demonstrates a basically cylindrically hollow peripheral wall 44, designed as a single piece with the bottom wall 28. One axial side of this peripheral wall 44 is preferably attached to the lid component 30 and, as seen in FIGS. 2 and 3, the other axial side is attached to an appropriate cylindrically hollow housing wall 46 of a motor supporting component 48. The cooling attachment 16 with its peripheral wall 44, the supporting component 48 with its housing wall 46, and the lid component 30 thus practically form a common housing for the electromotor 2 and the cooling arrangement. At least one radial exhaust port 50 for the cooling attachment 10 is formed, especially in the vicinity of attachment between the peripheral wall 44 of the cooling attachment 16 and the housing wall 46 of the supporting component 48. FIGS. 6 and 8 deal with a preferred exemplary embodiment of five exhaust ports 50, each partially formed by recesses of the supporting housing wall 46 and of the cooling attachment peripheral wall 44, the recesses being open on the edge.

In accordance with FIG. 2, it is furthermore advantageous for the partitioning wall 36 to demonstrate an axially extended, basically cylindrically hollow ring land 52 that is located on the side that is axially facing away from the rear-flow chamber 34 and that encloses the rotor 4 with a small radial gap across a portion of the rotor's axial length in such a manner that the cooling air stream 10, after it has flowed through or around the motor 2, will be radially guided away from the rotor 4 through the ring land 52 and outwardly toward the exhaust ports 50. The ring land 52 is also easy to recognize in FIG. 5.

Figure 1:
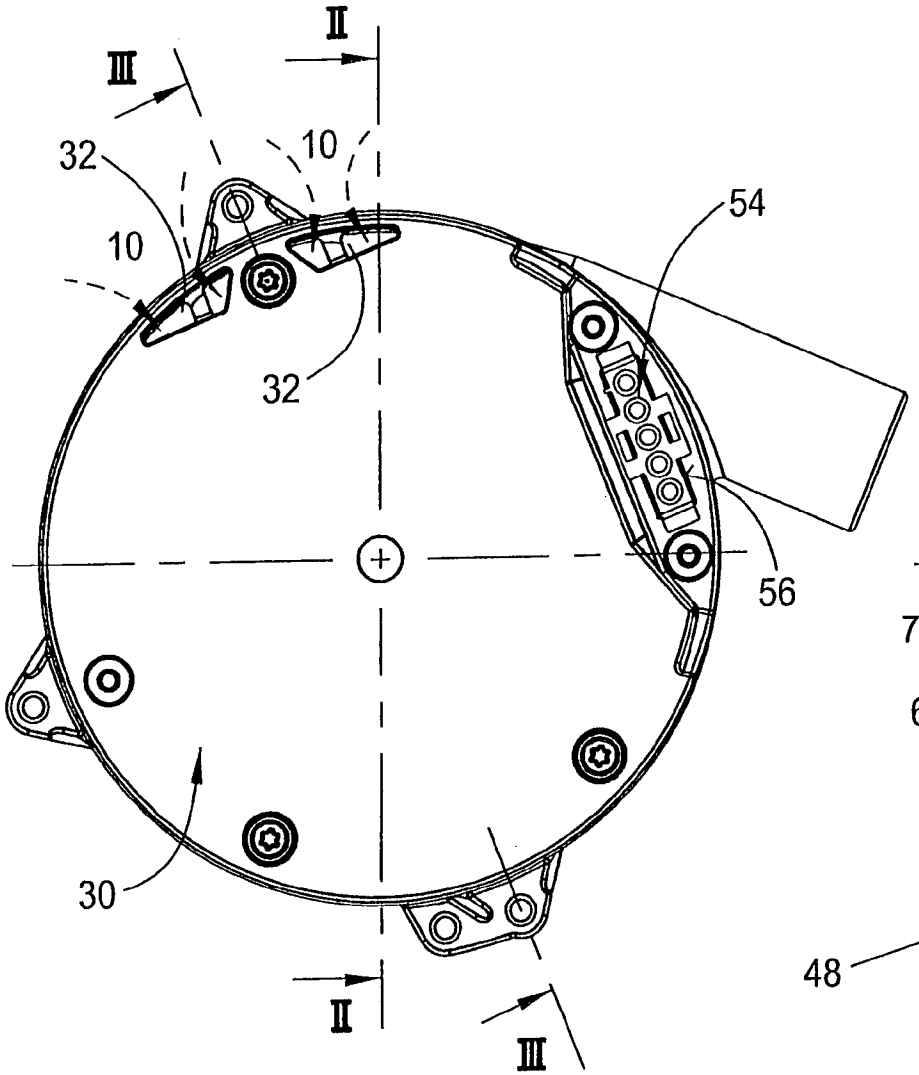
FIG. 1 an axial front view (view in the direction of the arrow I depicted in FIG. 2) of an electromotor equipped with a cooling arrangement according to invention, FIG. 2 an axial section in the plane II—II depicted in FIG. 1, FIG. 3 another axial section, but in the plane III—III depicted in FIG. 1, FIG. 4 a perspective exploded illustration of the basic components of the cooling arrangement according to invention in a first viewing direction (diagonally from the front), FIG. 5 a perspective exploded illustration similar to FIG. 4 in a second viewing direction (diagonally from the rear), FIGS. 6 and 7 each a perspective view of the cooling attachment according to invention on its interior and exterior surface, respectively, FIG. 8 a perspective view of the electromotor, FIG. 9 an axial section of the electromotor, FIG. 10 an external view of a blower in accordance with the invention, and FIG. 11 an axial section through the fan in FIG. 10.

As furthermore evident from FIG. 4, the motor electronics 14 demonstrates at least one plug-and-socket connector component 54 for connecting an external motor connecting cable (not illustrated) for the external motor connection. The lid component 30 possesses a connection opening 56 in the vicinity of the plug-and-socket connector component 54. The reader is referred to the front view in FIG. 1 for this.

Connector elements 58 (see FIG. 2), which are arranged in a holding recess 60 that is designed as a single piece with the partitioning wall 36, are appropriately provided for internally connecting the motor electronics 14 to the motor windings (cf. FIGS. 4 and 5). In accordance with FIG. 7, the bottom wall 28 of the cooling attachment 16 demonstrates a connecting hole 62 in the vicinity of the holding recess 60. In accordance with FIG. 2, a reciprocal connector element 64, which advantageously plugs together with the connector element 58, is arranged within the motor 2 (also see FIG. 8).

As depicted in FIG. 2, it is furthermore expedient for sealing means 66 to connect the bottom wall 28 of the cooling attachment 16 and the partitioning wall 36 in the region enclosing the holding recess 60 and the connecting hole 62, especially sealing means 66 similar to a labyrinth box with webs that mutually engage each other axially. This will prevent admission of cooling air into the housing compartment 18 in this region too.

As finally can still be seen from FIGS. 2 and 3 and from FIG. 9, the electromotor 2, together with a sheet stack of its stator 6, is seated on a bearing stay pipe 68 which, on the side that isn't enclosed by the rotor 4, is preferably connected as a single piece to a flange-like wall section 70 of supporting component 48 that extends perpendicular to the motor axis. A rotor shaft 72 is rotatably mounted within the bearing stay pipe 68 by means of bearing elements, the rotor shaft 72 projecting axially from the wall section and being attachable to practically any desired aggregate to be driven, such as a pump.

The supporting component 48 together with its components (housing wall 46, wall section 70, and preferably a bearing stay pipe 68 too) is designed as a single-pieced structural part, especially of metal or else plastic. The cooling attachment 16 consists of a material that conducts heat well, especially aluminum. The lid component 30 and the partitioning wall 36 can actually consist of any material, but especially plastic.

Figure 10:
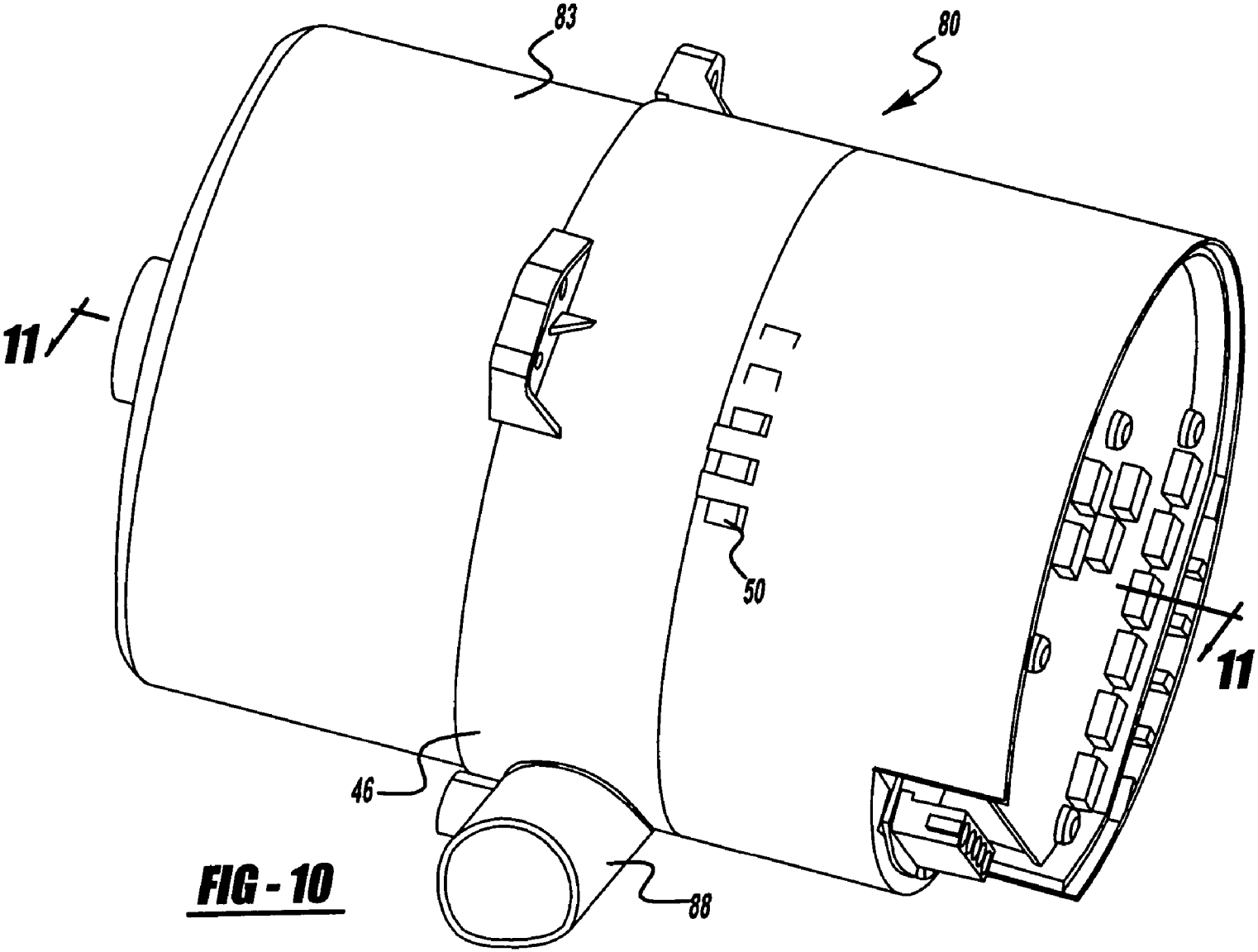
Figure 11:
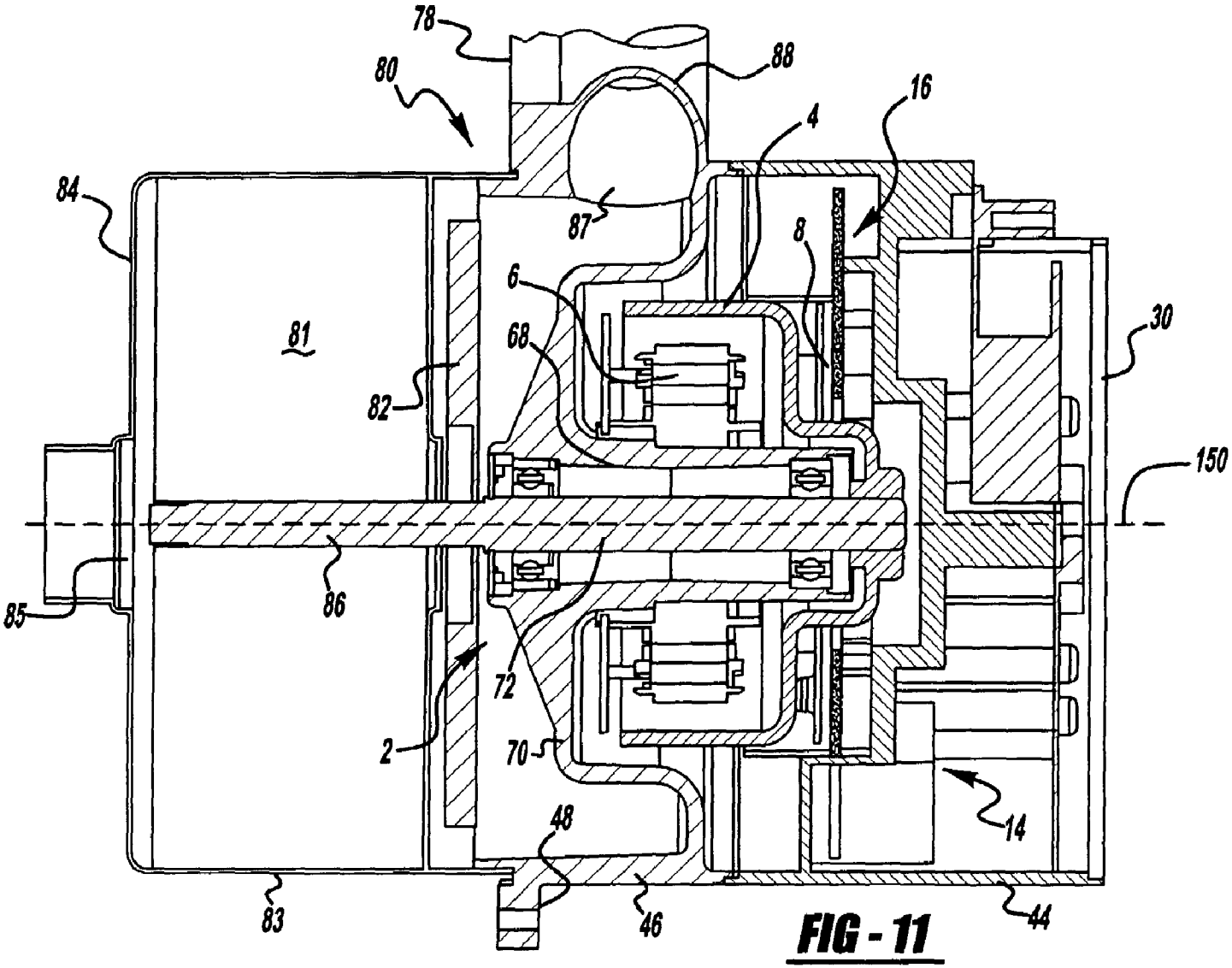

FIG. 10 illustrates a blower 80 according to invention. This blower is particularly suitable as a high-pressure blower. As illustrated in FIG. 11, it features a fan arrangement 81, comprising of a fan 82 and a fan housing 83. The fan 82 comprises of at least one fan impeller. However, several fan impellors can also be arranged behind each other. It is also possible to provide a stationary fan impeller between each of the individual fan impellors. The housing 83 demonstrates an aspirating hole 85 in the centerline X—X of the blower 80 in a front wall 84 of the housing 83. The fan arrangement 81 moreover possesses a fan shaft 86 upon which one or several fan impellors 82 are fastened. In the illustrated exemplary embodiment, the fan shaft 86 is designed as a single piece with the rotor shaft 72. The fan housing 83 is attached to the housing wall 46 since the housing encloses an annular collar of the housing wall 46 and is slid onto and fastened to this collar. The gap between the annular collar and the fan housing 83 is sealed. When the blower according to invention is in operation, working air is drawn in axially through the aspirating hole 85, and blown-off tangentially to the housing through a blower aperture 87 within the housing wall 46 by means of a molded connection piece 88. The wall section 70 of the supporting component 48 extends perpendicularly to the motor axis and forms a separation between the interior space for accommodating the electromotor 2 and the working air space of the fan arrangement 81, so that the working air flowing within the fan housing 83 is completely separated from the cooling air flowing inside the interior space of the electromotor 2. For this, it is provided that the passage of the motor shaft 72 through the wall section 70 is sealed airtight, so that the wall section 70 closes off one side of the interior space that the working air flows through.

As far of the rest of the design of electromotor 2 and the design of the cooling of the motor electronics 14 is concerned, let us refer to the embodiments represented by FIGS. 1 through 9 so that these details don't have to be repeated again in relation to FIGS. 10 and 11.

The invention is not limited to the exemplary embodiments that are illustrated and described, but includes all embodiments that work in the manner of the spirit of the invention. Furthermore, the invention is also not yet restricted to the combination of characteristics defined in Claim 1, but can also be defined by any other desired combination of particular characteristics of all disclosed individual characteristics as a whole. This means that practically any single characteristic of claim 1 can be omitted or replaced by at least one individual characteristic disclosed at another place in the application. To this extent, claim 1 must be understood merely as a first attempt at a formulation for an invention.

The invention claimed is:

1. An electromotor including electromotor self-ventilation, the electromotor comprising:

a cooling wheel provided on a rotor of the electromotor, the cooling wheel being configured to generate a cooling air stream flowing through said electromotor;

motor electronics arranged against direct contact with said cooling air stream, said motor electronics being chambered within a housing compartment bordered by a cooling attachment, said cooling air stream being conveyed past said housing compartment in such a manner that said cooling air stream flows over an outside surface of said cooling attachment, in which the outside surface is turned away from said motor electronics, and an inside surface of said cooling attachment, in which the inside surface is turned toward said motor electronics, with the outside surfaces standing in heat-conducting contact with components of said motor electronics to be cooled;

a fan and a fan housing, the fan housing for conveying an air flow of working air, the fan housing including a wall section separating a first interior space of said fan housing including said fan airtight from a second interior space housing the cooling wheel so that said cooling air stream flowing through said electromotor is separated and independent of the air flow of the working air conveyed by said fan;

wherein said motor electronics include a supporting plate, which mounts the motor electronics and extends perpendicular to the axis of the electromotor, said cooling attachment including a bottom wall, which is generally parallel to said supporting plate, and said bottom wall of said cooling attachment bordering said housing compartment on a side that is axially turned toward said electromotor, and a separate lid component, which is connected to said cooling attachment, bordering the other axial side that faces away from said electromotor, said housing compartment accommodating said supporting plate; and wherein the inside surface is turned toward the supporting plate, said bottom wall forming a face structure that is matched to said supporting plate of the motor electronics.

2. The electromotor as recited in claim 1 further comprising a blower aperture within the fan housing connected to the first interior space of said fan housing allowing the air flow of the working air and the fan housing being closed off on one side by said wall section.

3. The electromotor as recited in claim 1 wherein said motor shaft of said electromotor passes through said wall section and the vicinity of the passage is sealed airtight.

4. An electromotor including electromotor self-ventilation, the electromotor comprising:

a cooling wheel provided on a rotor of the electromotor, the cooling wheel being configured to generate a cooling air stream flowing through said electromotor;

motor electronics arranged against direct contact with said cooling air stream, said motor electronics being chambered within a housing compartment bordered by a cooling attachment, said cooling air stream being conveyed past said housing compartment in such a manner that said cooling air stream flows over an outside surface of said cooling attachment, in which the outside surface is turned away from said motor electronics, and an inside surface of said cooling attachment, in which the inside surface is turned toward said motor electronics, with the outside surfaces standing in heat-conducting contact with components of said motor electronics to be cooled wherein said cooling attachment together with a lid component forms at least one axial admission channel leading past said housing compartment, which channel, on said outside surface of said cooling attachment turned toward said electromotor, merges into a rear-flow chamber.

5. The electromotor as recited in claim 4, wherein said rear-flow chamber is formed axially between said bottom wall of said cooling attachment and an intermediate wall, said admission channel lying in the rear a partitioning wall having a transition hole for said cooling air stream flowing toward said electromotor.

6. The electromotor as recited in claim 4, wherein within said rear-flow chamber is formed on said outside surface of said bottom wall of said cooling attachment, by air guide ribs, in such a manner that said cooling air flow flows over said bottom wall on said outside surface of said cooling attachment uniformly.

7. The electromotor as recited in claim 5, wherein said partitioning wall includes an axially extended ring land, which is located on a side that is axially facing away from said rear-flow chamber and which locally encloses said rotor, in such a manner that said cooling air stream, after flowing through said electromotor, will be radially guided away from said rotor outwardly toward said exhaust port.

8. An electromotor including electromotor self-ventilation, the electromotor comprising:

a cooling wheel provided on a rotor of the electromotor, the cooling wheel being configured to generate a cooling air stream flowing through said electromotor;

motor electronics arranged against direct contact with said cooling air stream, said motor electronics being chambered within a housing compartment bordered by a cooling attachment, said cooling air stream being conveyed past said housing compartment in such a manner that said cooling air stream flows over an outside surface of said cooling attachment, in which the outside surface is turned away from said motor electronics, and an inside surface of said cooling attachment, in which the inside surface is turned toward said motor electronics, with the outside surfaces standing in heat-conducting contact with components of said motor electronics to be cooled;

wherein said motor electronics include a supporting plate, which mounts to the motor electronics and extends perpendicular to an axis of the electromotor, said cooling attachment including a bottom wall, which is generally parallel to said supporting plate, and said bottom wall of said cooling attachment bordering said housing compartment on a side that is facing said electromotor, and the lid component which is connected to said cooling attachment, bordering the other axial side that faces away from said electromotor, said housing compartment accommodating said supporting plate;

wherein said cooling attachment includes a peripheral wall connected as a single piece with said bottom wall, one side of which said peripheral wall is attached to said lid compartment and the other side thereof preferably being attached to a corresponding housing wail of a motor supporting component.

9. The electromotor as recited in claim 8, wherein at least one radial exhaust port for said cooling attachment is formed, generally in the vicinity between said peripheral wall of said cooling attachment and said housing wall of said supporting component.

10. The electromotor as recited in claim 8, wherein said electromotor, together with a stator is seated on a bearing stay pipe, the bearing stay pipe located on a side of the stator that is turned away from said rotor being connected as a single piece to a flange wall section of said motor supporting component.

11. An electromotor including electromotor self-ventilation, the electromotor comprising:

a cooling wheel provided on a rotor of the electromotor, the cooling wheel being configured to generate a cooling air stream flowing through said electromotor;

motor electronics arranged against direct contact with said cooling air stream, said motor electronics being chambered within a housing compartment bordered by a cooling attachment, said cooling air stream being conveyed past said housing compartment in such a manner that said cooling air stream flows over an outside surface of said cooling attachment, in which the outside surface is turned away from said motor electronics, and an inside surface of said cooling attachment, in which the inside surface is turned toward said motor electronics, with the outside surfaces standing in heat-conducting contact with components of said motor electronics to be cooled;

wherein said motor electronics includes at least one plug-and-socket connector component for the external connection to said electromotor, said plug-and-socket connector component being seated in an opening of a lid component, wherein said plug-and-socket connector component is provided for internally connecting said motor electronics to motor windings and are arranged in a holding recess designed as a single piece with said partitioning wall, said bottom wall of said cooling attachment including a connecting hole in the vicinity of said holding recess.

12. The electromotor as recited in claim 11, wherein said sealing device connect to said bottom wall and said partitioning wall within the region enclosing said holding recess and said connecting hole.

13. An electromotor including electromotor self-ventilation, the electromotor comprising:

a cooling wheel provided on a rotor of the electromotor, the cooling wheel being configured to generate a cooling air stream flowing through said electromotor;

motor electronics arranged against direct contact with said cooling air stream, said motor electronics being chambered within a housing compartment bordered by a cooling attachment, said cooling air stream being conveyed past said housing compartment in such a manner that said cooling air stream flows over an outside surface of said cooling attachment, in which the outside surface is turned away from said motor electronics, and an inside surface of said cooling attachment, in which the inside surface is turned toward said motor electronics, with the outside surfaces standing in heat-conducting contact with components of said motor electronics to be cooled;

wherein said electromotor is designed as an external rotor motor, said rotor being in the form of a bell-shaped external rotor enclosing an interior stator and, on a front side of the rotor carrying said cooling wheel, said rotor including axial flow holes for said cooling air stream.

14. The electromotor as recited in claim 13, wherein said rotor is designed stepwise, one region that is assigned to a closed side and elongated over the rotor being offset radially inwards by a step.

* * * * *